US007217456B1

(12) United States Patent
Rock et al.

(10) Patent No.: US 7,217,456 B1
(45) Date of Patent: May 15, 2007

(54) PLAITED DOUBLE-KNIT FABRIC WITH MOISTURE MANAGEMENT AND IMPROVED THERMAL INSULATION

(75) Inventors: Moshe Rock, Andover, MA (US); Edward P. Dionne, South Paris, ME (US); Charles Haryslak, Haverhill, MA (US); William K. Lie, Methuen, MA (US); Gadalia Vainer, Melrose, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 273 days.

(21) Appl. No.: 09/624,660

(22) Filed: Jul. 25, 2000

(51) Int. Cl.
*B32B 15/00* (2006.01)
*D02G 3/00* (2006.01)

(52) U.S. Cl. ..... 428/379; 428/367; 428/372; 428/920; 428/921; 442/327; 442/340; 442/341; 442/346; 442/351; 442/382; 442/384; 442/389; 442/400; 442/401; 442/417; 442/307

(58) Field of Classification Search ..... 442/327, 442/340–341, 346, 351, 382, 384, 389, 400–401, 442/307, 417; 428/372, 379, 920, 921, 367
See application file for complete search history.

(56) References Cited

U.S. PATENT DOCUMENTS

| | | | | | |
|---|---|---|---|---|---|
| 4,032,681 | A | * | 6/1977 | Jonnes | 442/317 |
| 4,357,387 | A | | 11/1982 | George et al. | |
| 4,425,397 | A | * | 1/1984 | George | 442/68 |
| 4,428,999 | A | | 1/1984 | George et al. | |
| 4,507,355 | A | | 3/1985 | George et al. | |
| 5,196,252 | A | | 3/1993 | Harpell | |
| 5,312,667 | A | * | 5/1994 | Lumb et al. | 428/91 |
| 5,359,736 | A | * | 11/1994 | Olivier | 4/420.2 |
| 5,393,597 | A | | 2/1995 | Childers et al. | |
| 5,480,706 | A | | 1/1996 | Li et al. | |
| 5,547,733 | A | | 8/1996 | Rock et al. | |
| 5,677,029 | A | | 10/1997 | Prevorsek et al. | |
| 5,901,379 | A | | 5/1999 | Hirata | |

FOREIGN PATENT DOCUMENTS

| | | | |
|---|---|---|---|
| JP | 02-182968 | * | 7/1990 |
| JP | 02182968 | * | 7/1990 |
| JP | 03-099448 | * | 8/1991 |
| JP | 09-087901 | * | 3/1997 |
| JP | 409087901 A | * | 3/1997 |
| JP | 11-279830 | * | 10/1999 |

* cited by examiner

*Primary Examiner*—Norca L. Torres-Velazquez
(74) *Attorney, Agent, or Firm*—Fish & Richardson P.C.

(57) ABSTRACT

A composite textile fabric for rapidly moving moisture away from the skin, and for retaining body heat, is provided. The composite fabric includes an inner fabric layer made of a yarn comprising a plurality of fibers primarily of polyester or other synthetic yarns which have been rendered hydrophilic, and an outer fabric layer made of a yarn comprising a plurality of fibers primarily of polyester or other synthetic yarns which have also been rendered hydrophilic. The inner fabric layer and the outer fabric layer are formed concurrently by knitting a plaited construction so that the layers are distinct and separate, yet integrated one with the other. The yarn fibers of the inner fabric layer are embedded with particles of a refractory carbide, or may be treated by metal vapor deposition to enhance the retention of body heat.

17 Claims, No Drawings

PLAITED DOUBLE-KNIT FABRIC WITH MOISTURE MANAGEMENT AND IMPROVED THERMAL INSULATION

BACKGROUND OF THE INVENTION

This invention relates to a composite textile fabric, and more particularly, to a composite textile fabric made of yarns which act to move liquid moisture away from the skin and through a garment made with the composite fabric, while at the same time providing improved thermal insulation.

Most polyester textile fabrics are likely to result in the substantial enclosure of liquid moisture between the wearer's skin and undergarments, or between the undergarments of the wearer and the outerwear due to perspiration of the wearer. When moisture saturation takes place, the wearer begins to feel uncomfortable.

U.S. Pat. No. 5,312,667, owned by Maiden Mills Industries, Inc., describes a composite textile fabric with a first layer made of either polyester or nylon material, and a second layer having a substantial portion of a moisture absorbent material, such as cotton. U.S. Pat. No. 5,547,733, also owned by Maiden Mills Industries, Inc., describes a composite textile fabric that includes an inner fabric layer made of a yarn comprising a plurality of fibers, primarily of polyester, which have been rendered hydrophilic, and an outer fabric layer made of a yarn comprising a plurality of fibers, primarily of polyester, which have also been rendered hydrophilic. For each of these patented textile fabrics, the two fabric layers are formed concurrently by knitting a plaited construction so that the layers are distinct and separate yet integrated one with the other.

While the textile fabrics described in both of these Maiden Mills patents are advantageous, they are less than desirable. In each of these textile materials, the thermal insulation provided is limited to the thermal properties of the yarn materials and the construction of fabric.

Accordingly, it would be desirable to provide a textile fabric which overcomes the above disadvantages and which facilitates liquid moisture transport to promote evaporation and keep the wearer dry, as well as providing for the retention of body heat to keep the wearer warm.

SUMMARY OF THE INVENTION

Generally speaking, in accordance with the invention, a composite textile fabric for rapidly moving liquid moisture away from the skin and evaporating that moisture from the surface of its outer surface is provided. The composite fabric includes an inner fabric layer, being the layer closer to the wearer's body, made of a yarn comprising a plurality of fibers of primarily polyester (or other synthetic yarns) which have been rendered hydrophilic, and an outer fabric layer, being the layer further from the wearer's body, made of a yarn comprising a plurality of fibers of primarily polyester (or other synthetic yarns) which have also been rendered hydrophilic. The polyester of the inner fabric layer may be a stretchable polyester such as ESP produced by Hoechst. Celanese or spandex such as DuPont's LYCRA® polyester to give the fabric elastic properties commingled or plaited with regular (not stretchable) polyester. The polyester of the outer fabric layer may be blended with absorbent material such as cotton, wool or rayon to enhance the fabric's capacity to absorb liquid moisture. The inner fabric layer and the outer fabric layer are formed concurrently by knitting a plaited construction so that the layers are distinct and separate, yet integrated with one another, and the fabric may be knit with an open mesh construction to give the fabric additional elasticity.

Significantly, the denier of the yarn fibers of the inner fabric layer is at least as great as the denier of yarn fibers of the outer fabric layer. As a result, moisture which collects along the inner fabric layer is transferred to the outer fabric layer as predicted for "wicking" by the Washburn equation (see E. A. Wulkow and L. C. Buckles, *Textile Research Journal,* 29:931 et seq., 1959), $$h=2\gamma \cos \theta/rpg$$

where h=vertical height of wicking, γ=surface tension of the liquid, θ=contact angle, r=radius of the tube, p=density of the liquid, and g=gravitational acceleration.

This "wicking" is the result of capillary action and is enhanced the finer the denier of the fiber of the outer fabric layer and the greater the difference in denier between the yarn fibers of the two layers.

In addition, the denier of the yarn (as opposed to the denier of the yarn fibers) of the inner fabric layer is no greater than the denier of the yarn of the outer fabric layer. This facilitates the horizontal spread of liquid moisture in the outer fabric layer so that moisture is more evenly distributed along this layer, as described by Hollies and his co-workers (see N. Hollies and M. Kaessinger, *Textile Research Journal,* 26: 829–835, 1956 and 27:8–13, 1957), $$S^I=\gamma \cos \theta_A r.t/2n$$

where $S^I$=horizontal distance traveled in time t, γ=surface tension of the liquid, r.=effective radius, $e_A$=an apparent advance contact angle, n=viscosity of the liquid, and t=time. This in turn further facilitates rapid evaporation of the moisture from the outer layer. The coarser yarn of the outer fabric layer increases that layer's liquid holding capacity and therefore the "sink effect" of the outer fabric layer which, in turn, facilitates rapid transfer of the liquid moisture from the wearer's skin thorough the inner fabric layer to the outer fabric layer.

It is well known that the human body radiates heat at wavelengths as low as 1 μm and above, peaking at 9–10 μm, and that particles of a refractory compound may be embedded in the polyester fibers of the inner fabric layer in order to promote the inward reflection of body heat. As an alternative, the inner fabric layer may be treated by vapor deposition of metals.

In application, the composite textile fabric of the invention is used in a variety of garments, including sweatshirts, sweatpants, underwear, bathrobes, and various types of exercise clothing. The inner fabric layer is worn against the skin or undergarment of the wearer. Moisture from the skin is quickly transported through this layer where it is carried to the outer fabric layer where it spreads for evaporation from the outside of the garment (the surface of the outer fabric layer).

Of significance is the fact that the fabric construction is plaited. This feature makes it possible for capillary action to move liquid moisture from the wearer's skin through the inner fabric layer to the outer fabric layer and helps to create a substantial moisture concentration gradient between the inner fabric layer (which quickly transports water from the skin) and the outer fabric layer (from which the moisture is evaporated). The effect is to increase the outer fabric layer "sink effect" and reduce the likelihood of liquid moisture backing up into the inner fabric layer because of a lack of liquid moisture capacity in the outer fabric layer. Accordingly, it is an object of the invention to provide an improved composite textile fabric for enhancing the transport of liquid moisture away from the skin.

It is also an object of the invention to provide an improved composite textile fabric having a plurality of polyester fibers for conducting liquid moisture.

Another object of the invention is to provide an improved composite textile fabric which has a plaited construction for promoting the moisture concentration gradient between the two layers.

Yet another object of the invention is to provide a composite textile fabric in which the difference in the denier of the yarn fibers facilitates the transport of moisture from the inner fabric layer to the outer fabric layer.

A further object of the invention is to provide a composite textile fabric in which the difference in the yarn denier facilitates the horizontal spread of moisture along the outer fabric layer which further increases the "sink effect" of the outer fabric layer and reduces the likelihood of moisture back-up into the inner fabric layer.

Still another object of the invention is to provide a composite textile fabric with improved thermal insulation in which the inner fabric layer is modified to promote the retention of body heat by reflecting energy at wavelengths of 2 μm and above back to the wearer.

Still other objects and advantages of the invention will in part be obvious, and will in part be apparent from the following description. For example, an additional object will be to give the fabric elasticity by replacing the polyester of the inner fabric layer with a stretchable polyester such as ESP produced by Hoechst Celanese or with spandex such as DuPont's LYCRA® commingled or plaited with regular (not stretchable) polyester or by knitting the fabric with an open mesh construction. An additional object will be to give the fabric a higher capacity to absorb moisture by blending the polyester of the outer fabric layer with an absorbing material such as cotton, wool or rayon.

The invention accordingly comprises the several steps and the relation of one or more of the steps with respect to each of the others, and the material or materials having the features, properties and relation of constituents which are exemplified in the following detailed disclosure, and the scope of the invention will be indicated in the claims.

DETAILED DESCRIPTION OF THE PREFERRED EMBODIMENT

The composite textile fabric of the invention includes an inner fabric layer, being the layer closer to the wearer's body, made of yarn comprising a plurality of fibers of primarily polyester (or other synthetic yarn such as acrylic, polypropylene or nylon) which have been rendered hydrophilic, and an outer fabric layer, being the layer further from the wearer's body, made of the yarn comprising a plurality of fibers of primarily polyester (or other synthetic yarn such as acrylic, polypropylene or nylon) which have also been rendered hydrophilic. Both fabric layers are formed concurrently by knitting a plaited construction so that the layers are distinct and separate, yet integrated one with the other.

The amount of each fabric layer is selected based on the desired weight of the composite fabric, the desired end use of the composite fabric, and the specific requirements for transferring moisture from the inner fabric layer to the outer fabric layer. The weight per unit area of the composite fabric is between about 2 ounces/yard$^2$ and 20 ounces/yard$^2$, depending upon the requirements for thermal protection and moisture control.

The construction of the composite fabric, as set forth above, is such that it has a plaited construction—although each fabric layer is distinct and separate, each is integrated with the other. As a result, the composite fabric functions as a single unit.

The composite fabric is a circular knit fabric, such as a two-end fleece, three-end fleece, terry with regular plaiting, double terry, tricot, single knit jersey and double knit jersey.

Significantly, the denier of the yarn fibers of the inner fabric layer is at least as great as that of the yarn fibers of the outer fabric layer. This facilitates the transport of liquid moisture which collects on the inner fabric layer to the outer fabric layer. When moisture collects on the inner fabric layer, since the denier of the inner layer yarn fibers is at least as great as that of the outer layer yarn fibers, and, therefore, the inter-fiber space in the yarn of the inner fabric layer is the same as or greater than that of the outer fabric layer yarn, the quick transfer of moisture from the first layer to the second layer due to capillary action is facilitated.

Also of significance is the fact that the denier of the yarn of the inner fabric layer is no greater than the denier of the yarn of the outer fabric layer. This facilitates the horizontal spreading of moisture along the outer layer—in other words, moisture collected by the inner fabric layer is transferred to the outer layer and more evenly distributed on the outer layer. As a result of the spreading along the outer fabric layer, overall moisture is more rapidly transported from the inner fabric layer to the outer fabric layer of the composite textile fabric, since there is a lesser build-up of moisture in specific fabric locations in the outer fabric layer. Also, because the yarn of the outer fabric layer is coarser than the yarn of the inner fabric layer, the likelihood of a "sink effect" in the outer fabric layer is increased and the likelihood of liquid moisture back-up into the inner fabric layer where it would wet the skin of the wearer, is reduced.

More specifically, the yarn fibers of the inner fabric layer are in a range of between about 0.7 denier and 6.0 denier, and the yarn fibers of the outer fabric layer are within a range of between about 0.3 denier and 2.5 denier.

The denier of the yarn (itself) of the outer fabric layer is in a range of between about 100 denier and 300 denier, while the denier of the yarn of the inner fabric layer is in a range of between 50 denier and 150 denier.

Preferably, the yarn of the inner layer is a small denier filament yarn and the yarn of the outer layer is a large denier spun yarn, multifilament yarn or a combination of both. As a result, the spreading of liquid moisture along the surface of the outer layer is enhanced and the back up of liquid moisture to the inner layer is reduced. If the yarn of the outer layer is air jet spun, the outer layer will have, in addition, enhanced non-pilling characteristics.

In order to render each of the inner and outer layers hydrophilic, a material such as a low molecular weight polyester may be added to the dye bath that is used to dye the fabric. Reference is made to U.S. Pat. No. 5,312,667 which is hereby incorporated by reference for its teaching and description of various types of low molecular weight polyesters that are suitable for the inventive composite textile fabric.

By chemically treating the fabric, each layer is rendered substantially hydrophilic. As a result, the transfer of liquid moisture from the surface of the inner fabric layer to the outer fabric layer is enhanced; liquid moisture is made transportable along the surface of each polyester fiber.

Moisture that has been conducted to the outer fabric layer spreads along the surface of the layer, is rapidly evaporated (it is not absorbed), and therefore, the outer fabric layer will rapidly dry.

Optionally, the polyester of the outer fabric layer may be further treated, for example, by topical application, such as by applying a low molecular weight polyester by padding, to render it more hydrophilic than the polyester of the inner fabric layer, thereby increasing the driving force or liquid moisture transport from the inner fabric layer to the outer fabric layer.

Also, the outer fabric layer may have an absorbent fiber such as cotton, wool or rayon blended with the polyester that has been rendered hydrophilic. As is well known, the capacity of cotton to absorb moisture increases as the ambient relative humidity increases. For example, at a relative humidity of 65%, cotton will absorb 7.4% moisture but at a relative humidity of 95%, it will absorb more than 13%. Hence, the cotton blended with the polyester can accommodate the extra moisture generated by the wearer, for example, during physical exertion, and the moisture level in the "micro-climate" between the wearer's skin and the inner fabric layer can be kept at a dry and comfortable level, further increasing the comfort level of the wearer.

Furthermore, the surface area of the inner fabric layer may be enlarged by a raising process, such as sanding, napping or brushing. This produces a fabric surface with less contact between the inner fabric layer and the wearer's skin than a flat fabric. As a result, the inner fabric layer is less conductive and more insulative than a flat fabric because of the air pockets inherent in a raised surface fabric, thereby reducing overall heat loss from the wearer's body.

Preferably, in order to promote the non-pilling characteristics of the outer polyester fabric layer, the yarn fibers of the outer fabric layer are air jet spun when forming the yarn. As a result, a tighter yarn is created which is less susceptible to pilling since the yarn fibers are held more closely together. Moreover, the air jet spun yarn of the outer fabric layer will have a cotton-like look without being made from an all cotton or cotton-like material.

Significantly, particles of a refractory compound are embedded into the fibers of the inner fabric layer yarn. This is achieved by either dispersing the particles in the master batch polymer prior to spinning or by injecting the particles into the spinneret that is used for extruding the fibers from the polymer. These refractory particles reflect low energy radiation of wavelengths greater than 2 μm. Since the human body radiates heat at wavelengths above 1 μm, peaking at 9–10 μm, use of yarn that incorporates refractory compounds promotes reflection of body heat by the inner fabric layer back to the body of the fabric wearer, thereby reducing overall heat loss and enhancing insulation and in a raised surface fabric the refractory compound particles reflect the radiated body heat through the air spaces inherent to such fabrics back to the body. Also, the inner fabric layer will absorb some of the near infrared radiation (less than 2 μm) emanating from the wearer's skin or from the ambient environment. The refractory compound may be selected, for example, from Group IV transition metal compounds, such as carbides and oxides, including titanium carbide, zirconium carbide and hafnium carbide and zirconium oxide. The preferred refractory carbide compound is zirconium carbide. THERMOTRON® is a polyester yarn than contains zirconium carbide particles and may be obtained from Unitaka of Osaka, Japan.

Alternatively, the inner fabric layer of the inventive fabric may be treated by metal vapor deposition, a well known coating process. In accordance with the invention, a metal vapor deposit utilizing aluminum, copper or some other metal may be applied to the inner fabric layer by means of metal vapor deposition. Such treatment is most suitable where the inventive fabric is finished as a raised surface fabric, thereby effecting a reduction in conductive heat loss.

It will thus be seen that the objects set forth above, and those made apparent from the preceding description, are efficiently attained, and since certain changes may be made in the products set forth above without departing from the spirit and scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

The invention claimed is:

1. A composite textile fabric comprising an inner fabric layer made of a yarn comprising a plurality of fibers of polyester or other synthetic yarn which have been rendered hydrophilic, and an outer fabric layer made of a yarn comprising a plurality of fibers of polyester or other synthetic yarn which have also been rendered hydrophilic;

wherein the inner fabric layer and outer fabric layer are formed concurrently by knitting a plaited construction;

wherein particles of a refractory compound are embedded only within said plurality of yarn fibers of said inner fabric layer; and wherein said inner fabric layer has a surface area enlarged by a raising process for creating air spaces to enhance insulation performance and for reducing contact of the inner fabric layer upon a wearer's skin, and substantial portion of the particles of the refractory compound are spaced from the surface of the skin, due to the raising process, to cause body heat reflected by the particles to travel through the trapped air space of the raised surface region for insulated warming of the wearer's skin.

2. The textile fabric of claim 1, wherein said other synthetic yarn of each of said fabric layers is selected from the group consisting of acrylic, polypropylene and nylon.

3. The textile fabric of claim 1, wherein the denier ratio of the yarn fibers of the inner fabric layer is at least as great as the denier of the yarn fibers of the outer fabric layer.

4. The textile fabric of claim 1, wherein the denier of the yarn of the inner fabric layer is no greater than the denier of the yarn of the outer fabric layer.

5. The textile fabric of claim 1, wherein the denier of the yarn fibers of the inner fabric layer is at least great as the denier of the yarn fibers of the outer fabric layer and the denier of the yarn of the inner fabric layer is no greater than the denier of the yarn of the outer fabric layer.

6. The textile fabric of claim 4, wherein the yarn fibers of the inner fabric layer have a denier of between about 0.7 and 6.0 and the yarn fibers of the outer fabric layer have a denier of between about 0.3 and 2.5.

7. The textile fabric of claim 5, wherein the yarn of the outer fabric layer has a denier between about 100 and 300 and the yarn of the inner fabric layer has a denier of between about 50 and 150.

8. The textile fabric of claim 1, wherein said compound is selected from the group consisting of titanium carbide, zirconium carbide and hafnium carbide.

9. The textile fabric of claim 1, wherein the yarn of the inner layer is a small denier filament yarn.

10. The textile fabric of claim 1, wherein the yarn of the outer fabric layer is spun, multifilament or a combination thereof.

11. The textile fabric of claim 10, wherein the yarn fibers of the outer fabric layer are air jet spun.

12. The textile fabric of claim 1, wherein said fabric is selected from the group comprising two-end fleece, three-end fleece, terry with regular plaiting, double terry, tricot, single knit jersey and double knit jersey fabrics.

13. The textile fabric of claim 1, wherein each of said layers has an elastomeric yarn plaited therein.

14. The textile fabric of claim 1, wherein the fabric has a weight per unit area of between about 2 ounces/yard$^2$ and 20 ounces/yard$^2$.

15. The textile fabric of claim 1, wherein the yard fibers of the outer fabric layer are more hydrophilic than the yarn fibers of the inner fabric layer.

16. The textile fabric of claim 1, wherein the outer fabric layer includes yarn fibers made of cotton or other absorbent fibers that are blended with the yarn fibers made of a polyester or other synthetic material.

17. The textile fabric of claim 1, wherein said inner fabric layer has a surface that is enlarged by a raising process selected from the group consisting of sanding, napping and brushing.

* * * * *